United States Patent [19]

Stamm

[11] Patent Number: 4,907,614

[45] Date of Patent: Mar. 13, 1990

[54] CARRYING ATTACHMENTS FOR UMBRELLAS

[75] Inventor: Peter Stamm, Leichlingen, Fed. Rep. of Germany

[73] Assignee: Kortenbach Verwaltungs-und Beteiligungung Sggesellschaft mbH & Co., Soligen, Fed. Rep. of Germany

[21] Appl. No.: 216,358

[22] Filed: Jul. 7, 1988

[30] Foreign Application Priority Data

Mar. 8, 1988 [DE] Fed. Rep. of Germany ..... 3807537

[51] Int. Cl.[4] ..... A45B 9/02

[52] U.S. Cl. ..... 135/20 R; 294/137

[58] Field of Search ..... 135/20 R, 76; 24/265 R, 24/114.5, 128; 294/137, 171, 158, 167; 224/915

[56] References Cited

U.S. PATENT DOCUMENTS

| | | | |
|---|---|---|---|
| 1,413,247 | 4/1922 | Wilson | 24/128 R |
| 2,493,705 | 1/1950 | Vogel | 224/915 |
| 2,551,963 | 5/1951 | Myers | 135/20 R |
| 2,724,881 | 11/1955 | DiMaria | 24/128 R |
| 3,473,541 | 10/1969 | Pasch | 135/44 |
| 3,580,262 | 5/1971 | Weber | 135/20 R |
| 3,636,594 | 1/1972 | Faivre | 294/137 |
| 3,799,180 | 3/1974 | Weber | 135/20 R |
| 3,988,810 | 11/1976 | Emery | 24/128 R |
| 4,616,868 | 10/1986 | Okuda | 135/20 R |
| 4,624,276 | 11/1986 | Allen | 135/20 R |
| 4,632,137 | 12/1986 | Exley et al. | 135/20 R |
| 4,730,863 | 3/1988 | Guadnola | 294/167 |

FOREIGN PATENT DOCUMENTS

| | | | |
|---|---|---|---|
| 8624451 | 12/1986 | Fed. Rep. of Germany . | |
| 44142 | 6/1927 | Norway | 24/128 R |
| 1428100 | 3/1976 | United Kingdom . | |

*Primary Examiner*—David A. Scherbel
*Assistant Examiner*—Caroline D. Dennison
*Attorney, Agent, or Firm*—Samuel Meerkreebs

[57] ABSTRACT

In order to permit a flexible carrying handle to be more easily fitted into and removed from a known securing eyelet in an umbrella handle, a permanently open threading slot running the length of the eyelet is provided. The slot is narrower than the eyelet. The carrying handle can be squeezed along the slot into the eyelet, where the carrying handle regains its normal shape and thus will not unintentionally slip back out of the eyelet.

9 Claims, 3 Drawing Sheets

CARRYING ATTACHMENTS FOR UMBRELLAS

FIELD OF INVENTION

1. Background of the Invention

The invention relates to an umbrella frame comprising a handle mounted on one end of a stick, a crown mounted on the other end of the stick and at least one eyelet located in the umbrella handle and/or the crown for receiving a deformable carrying member of appropriate size.

2. Description of Prior Art

Such an umbrella frame is shown in British Pat. No. 1428100, which discloses that the carrying member, comprising an endless loop, is secured in eyelets moulded into the umbrella handle and/or into the crown by means of threading the member directly through the eyelet or eyelets at one end or at both ends of the umbrella. U.S. Pat. No. 3,473,541 describes an umbrella frame and an arrangement in which each of the two ends of a two ended member forming the carrying member is threaded through an eyelet and, after threading, secured against release by the attachment of securing means. Although these arrangements enable the carrying member to be inserted directly into the eyelet without the need for complicated coupling or locking means between the handle or crown and the carrying member, they have the disadvantage that the carrying member must, in a first procedural step, first of all be threaded into the eyelet or eyelets. Only then is it possible for the ends of the carrying member to be either joined together to form a loop (as in British Pat. No. 1,428,100 or alternatively provided with securing means, such as thickened portions, knots, rings, pins or other types of stops (as in U.S. Pat. No. 3,473,541), in order thereby to secure the two-ended member against release from the eyelet or eyelets. Thus, accordingly, such known arrangements for attaching the carrying member to an umbrella handle or to the crown of an umbrella frame require tow procedural steps. These steps must be accomplished by experts or skilled artisans and by means of tools in the umbrella factory or in an umbrella workshop. This applies likewise to any subsequent replacement of the carrying member. In addition, there is the fact that, when a carrying loop is removed from the umbrella handle or the crown, the ring-shaped loop structure must be parted or the means for securing against release by removed from the ends of the loop.

To avoid fastening an endless carrying loop by means of the threading procedure described above and to be able to attach the carrying loop to the umbrella handle as a complete ring-shaped structure and remove it again in this form, it is proposed in -U-German Gerbrauchmuster 8624451.5 that the eyelet be designed in the form of a channel which is accessible from outside, that the loop be inserted into this channel and that thereupon the channel is closed by means of a fixed clamping piece which is pressed into the channel, thereby trapping in place the loop. It is also necessary in this case for the fastening and removal of the carrying loop to be accomplished by professional mechanics using a suitable tool in the umbrella factory or the umbrella workshop. In addition, this fastening with a clamping piece requires an additional component and an additional procedural step for the pressing in and lifting out of the clamping piece. Furthermore, because the carrying loop is tightly gripped, this fastening arrangement does not allow the carrying loop to be movable in the eyelet and hence also does not allow the loop to be designed as a loop of adjustable length. In the final analysis, the operation of pressing in and lifting out is not without problems as there is the risk of deforming or damaging the clamping piece or the carrying loop during these operations.

SUMMARY OF THE INVENTION

The object on which the invention is based is to simplify or improve the fastening of a carrying member to an umbrella frame so that both an endless loop and a two-ended carrying member provided with thickened portions at its ends can be introduced into the eyelet(s) in one operation and by anyone, i.e. even by the user of the umbrella, can be secured therein immediately, against unintentional accidental release, and can, if necessary, also be removed therefrom with equal ease without the need for any additional clamping, locking or connecting components, tools or specialist knowledge and without damaging the carrying loop, and that it is possible, moreover, at the same time and in a simple manner, to design the carrying member so as to be of adjustable length.

According to the invention, this object is achieved by a frame characterised in that access is provided to the/or each, eyelet by a permanently open threading slot running axially of the eyelet and having a breadth less than the internal width of the eyelet, whereby the slot is arranged to permit frictional sliding into the eyelet of the carrying member, when the member has been deformed to change shape to pass through the slot, but to inhibit subsequent unintentional release of the carrying member. thus, the carrying member, comprising, for example, a cord, string, belt or strap known per se, can be introduced ready to use, i.e. as a loop or a two-ended member provided with thickened portion(s), by a single manipulation into the eyelet, and can be secured therein immediately against unintentional release and, should removal be necessary, can easily be removed therefrom.

This introduction and securing and removal of the carrying member into or from the eyelet(s) can be performed very easily and even very simply at any time by the user of the umbrella. It is achieved by laying the carrying member lengthwise directly along the threading slot and by subsequent application of tension to the carrying member. During the insertion of the carrying member, it should be immobilized over the threading slot by the hand gripping the umbrella frame, while the carrying member is tensioned with the other hand until, as a result of the tensioning effect, its inherent stretch and a certain pliability, it forces its way with clamping and frictional engagement through the threading slot and into the eyelet. Once the tension on the carrying member has been relieved, the member expands again to its untensioned diameter, which may be matched to the diameter of the eyelet. After this, all that remains is for the carrying member, insofar as it is not a loop but is two-ended, to be pulled through the eyelet(s) until its thickened portion, which serves as a means for securing against pulling through, comes up against one end of an eyelet.

The removal of the carrying member from the eyelet or eyelets is accomplished in an equally simple manner. The carrying member is merely tensioned by one hand away from the eyelet towards the threading slot until it slips out of the eyelet into the threading slot. The fastening of a two-ended carrying member, or a carrying loop which has been joined together to form a ring, by pulling it into the eyelet through the threading slot permits a simple and stress-resistant design of the carrying member and the eyelet(s), the umbrella handle and the crown, with the simple assembly and disassembly being retained without altering the carrying member or damaging or destroying it and without recourse to securing or locking components and tools.

Furthermore, the invention also makes possible a simple adjustment or shortening or lengthening of the two-ended version of the carrying member, because it is simple to insert the carrying member, provided with thickened portions arranged in a row one behind the other, at any point more or less near its end, into the eyelet.

Preferably, the threading slot tapers towards the eyelet.

Usually, the threading slot lies in a plane transverse to, parallel to or containing the longitudinal axis of the stick.

In order to help the carrying member fit into the threading slot, the slot may be provided with edges remote from the eyelet that are rounded.

Preferably, the umbrella handle has two eyelet/threading slot pairs, whereby a variable length of the carrying member may be stored wrapped around the handle between the two eyelets.

Examples of umbrella frames constructed in accordance with the invention are illustrated in the accompanying drawings, in which:

Figure 1:
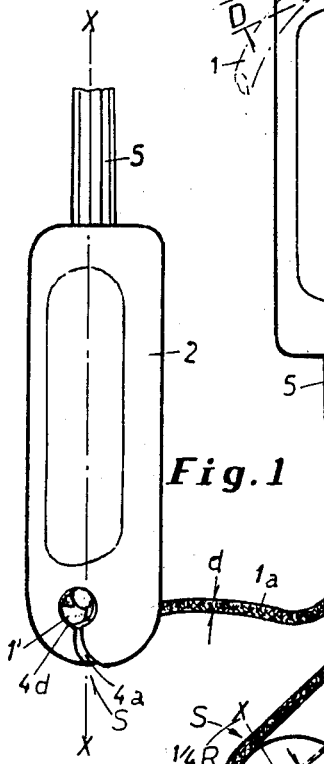
FIG. 1 is a perspective view of a first embodiment showing an umbrella handle incorporating the attachment for a carrying member.
Figure 2:
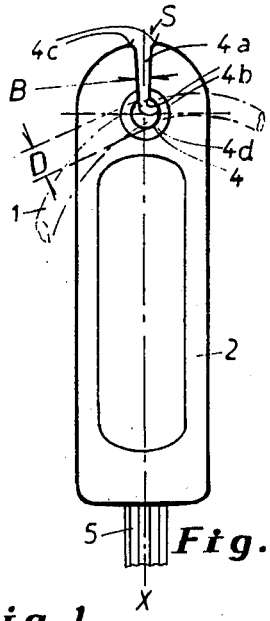
FIG. 2 is an inverted elevational view of FIG. 1.
Figure 3:
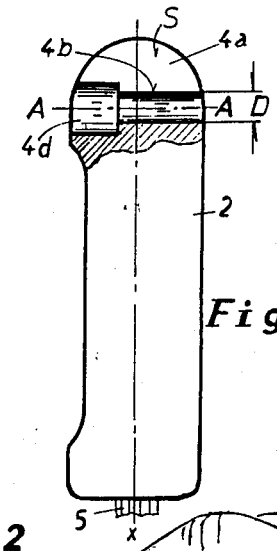
FIG. 3 is a side elevational view of FIG. 2, with portions broken away to show construction details.
Figure 4:
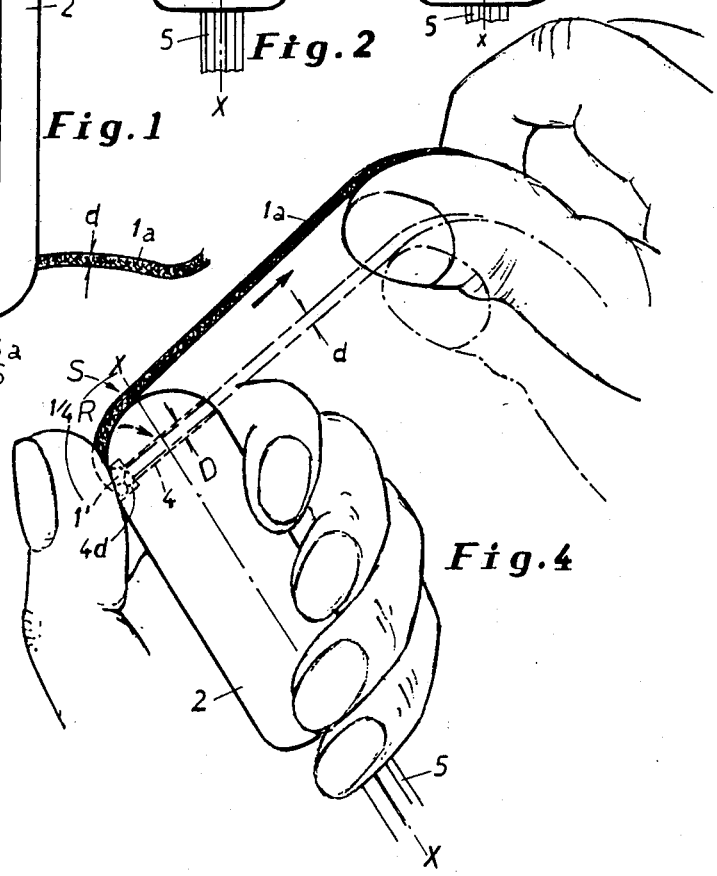
FIG. 4 is a diagramatic elevation illustrating the manipulation involved in sliding a deformable carrying member into an eyelet of the handle of FIGS. 1–3.

Referring to the Figures, the umbrella frame of which a handle 2 forms part may be telescopic or non-telescopic. A flexible and deformable carrying member 1, known per se, in the form of a two-ended member 1*a* or an endless loop 1*b*, of a cord, a string, a belt or strap, is held in an eyelet 4 formed in the umbrella handle 2 and/or in a crown 3. The umbrella handle 2 is fixed to the lower end and the crown 3 to the upper end of a telescopic or non-telescopic umbrella stick 5 known per se. The stick 5 has a longitudinal axis X. A mechanism of any desired design for moving a canopy 6 attached to the umbrella frame is mounted on the umbrella stick 5.

Figure 5:
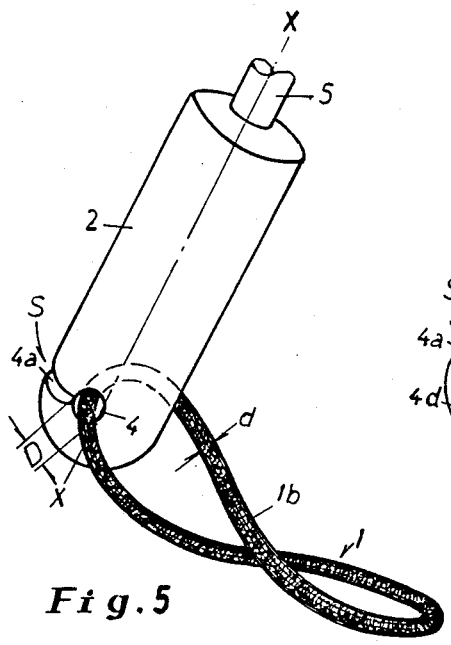
FIG. 5 shows a second embodiment of an umbrella handle incorporating the invention.

The diameter D of the eyelet 4 formed in the umbrella handle 2 and in the crown 3 is matched to the diameter d of the carrying member 1 so as to produce a fit which will allow sliding of the member through the eyelet, and the eyelet can be arrangeed to intersect the axis X of the umbrella shaft in accordance with FIGS. 1–4, 6, 7, 8, 9 or be arranged offset form the axis X, for example as can be seen from FIG. 5.

Figure 9:
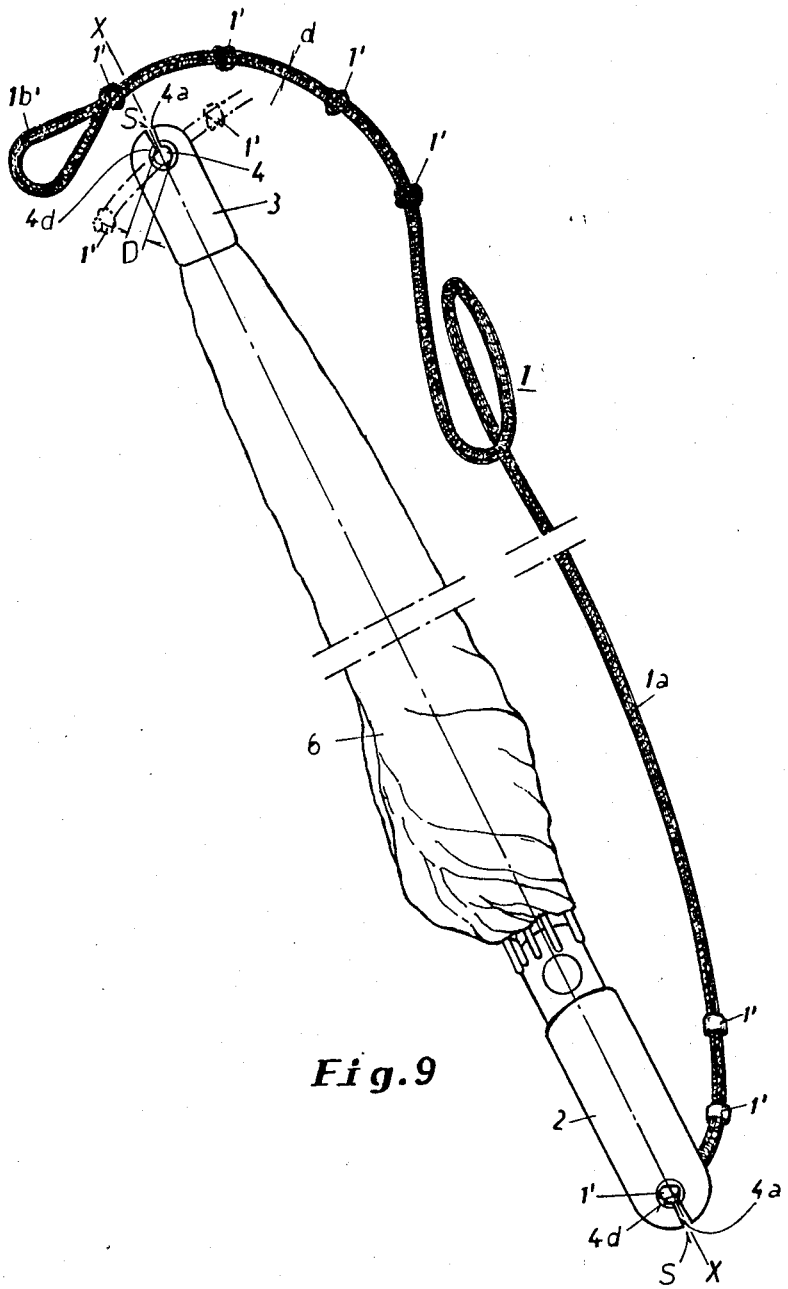
FIG. 9 shows an umbrella frame including a stick having in its handle and crown an attachments for the carrying member according to the embodiment illustrated in FIGS. 1–4.

In the case of a two-ended member 1*a*, as shown in FIGS. 1, 4, 6, 8, 9, the member 1*a* is provided with thickened portions 1′ known per se, such as, for example, knots, compression-fitted bushes, beads or the like. These thickened portions 1′ are fitted to the ends of the two-ended member 1*a* and several of them may also be fitted in a row one behind the other (FIG. 9). The thickened portions in each case can rest against one of the openings of the eyelets 4 and thus form stops or securing means to prevent pulling out from the umbrella handle 2 or the crown 3. If the carrying member 1 is an endless loop 1*b*, for example as shown in FIGS. 5 and 7, or if at least one of ends of the carrying member is in the form of a closed loop, for example as in accordance with FIG. 9, at the crown end, the loop itself acts as securing means to prevent pulling out.

Hitherto, these thickened portions 1′ were always fitted on the carrying member 1 only when the member had been threaded through the eyelet(s) in the umbrella handle 2 and the crown 3 since, of course, otherwise it was impossible to thread it directly through the eyelet(s) 4. Accordingly, it was only possible to fit or remove the carrying member 1 in a direct eyelet retention system of this kind in the umbrella factory or in the umbrella workshop using appropriate aids. Because of the necessary removal of the thickened portions 1′, the carrying member 1 was in the majority of cases damaged or destroyed during removal. Even when a carrying loop is laid in the known manner in an eyelet in the form of a channel accessible from outside and is then held in this channel by means of a special locking piece, a fastening operation of this kind can only be performed in an umbrella factory or umbrella workshop with the aid of suitable tools. Furthermore, separate aids have hitherto been necessary for adjusting the length of the loop as and when required. To enable the carrying member 1 to be introduced into the eyelet(s) 4 in its ready to use form, i.e. provided with the thickened portions 1′ or joined together to form a ring, and to be secured in the eyelet(s) and removed again therefrom by anyone, as desired, at any time and in a simple manner, without problems and without causing damage or destruction, irrespective of whether it is a two-ended member 1*a* or a loop 1*b*, the invention provides a clamping channel 4*a* in the form of a threading slot S opening into each eyelet 4. This threading slot runs parallel to the eyelet axis A and its breadth B is less than the diameter of the eyelet 4 such that the carrying member 1 can be laid longitudinally in the clamping channel 4a or threading slot S and, by tension on and concomitant material compression of the carrying member 1, be pulled through the threading slot S or clamping channel 4*a*, in accordance with the illustration of the manipulation given in FIG. 4, into the channel base of the eyelet 4.

At its simplest, this can be accomplished by simultaneously immobilizing the carrying member 1 over the mouth of the threading slot S with the thumb of the hand holding the umbrella (in the case of the two-ended member 1*a*, the thickened portion 1′ is simultaneously immobilized at the outer edge of the threading slot S) and, with the other, free hand, pulling the carrying member 1 taut in the direction of the slot until, by reason of the tensioning, material stretch and material compression, already described, of the carrying member 1, the carrying member 1 passes through the clamping channel 4a into the eyelet 4. Because of the narrower dimensions of the threading slot S with respect to the eyelet 4 and also because of the material relaxation and reexpansion of the carrying member 1 itself in the eyelet 4, the carrying member 1, which has been pulled lengthwise into the eyelet 4, is thereafter held therein just as well as in known constructions not having the thread in slot S, without reducing the security of retention. The relatively abrupt edges 4b, 4b along which the clamping channel 4a opens into the eyelet 4 also contribute to this security of retention in that these edges 4b, 4b act to a certain extent as securing hooks.

In order to slip past these edges 4b, 4b when the carrying member 1 is being pulled out of the eyelet 4 by a pulling action directed away from the umbrella handle 2 or crown 3, a somewhat greater exertion of force is therefore necessary than when the carrying member 1 is being inserted into the eyelet 4. However, the edges 4b, 4b are nevertheless rounded enough to permit the carrying loop 1 to be pulled out again in a simple manner and without problems. To facilitate the isnertion of the carrying member 1, the threading slot S can be tapered towrads the eyelet 4 and have rounded inlet edges 4c, 4c. Depending on the constraints imposed by different designs of umbrella frames, handles and crown and depending on the type of carrying member 1 to be used, the eyelet 4 can run transverse to (FIG. 5, 6, 7) or parallel to/along (FIG. 1–4, 8, 9) the axis X of the umbrella stick. Thus, the threading direction from the threading slot S towards the eyelet 4 can be towards the canopy 6 of the umbrella (FIG. 1–4, 9) or away from the umbrella (FIG. 8) or transverse to it (FIGS. 5–7).

Figure 6:
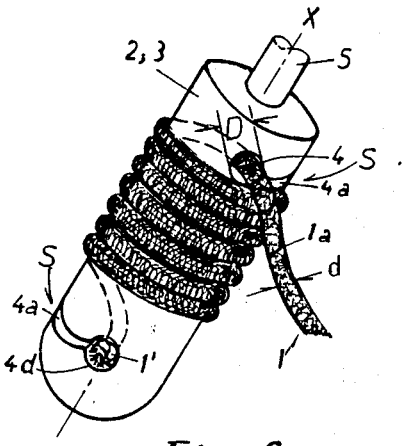
FIG. 6 shows a third embodiment of an umbrella handle incorporating the invention.
Figure 7:
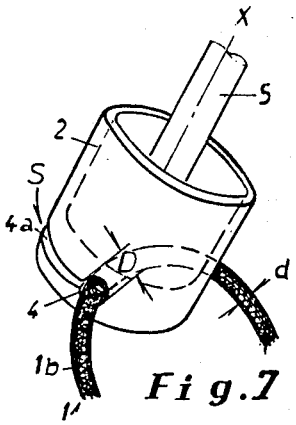
FIG. 7 shows a fourth embodiment of an umbrella handle incorporating the invention
Figure 8:
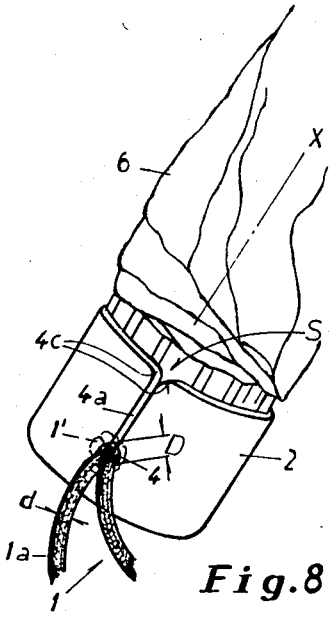
FIG. 8 shows an umbrella handle showing a fifth embodiment of the invention.

In the case of two threading slots S, S pointing in opposite directions, for example as shown in FIG. 6, with correspondingly associated eyelets 4, 4 in an umbrella handle 2 or a crown 3. there is the possibility of winding the carrying member 1 around the body of the handle or top to a greater or lesser extent and fixing it in this condition, and in this simple way shortening or lengthening it. Another possibility for shortening or lengthening the carrying member 1 is achievable by reason of the fact that, where a plurality of thickened portions 1' are arranged in a row at intervals one behind the other, such as in FIG. 9, the carrying member 1 can be inserted into the eyelets 4 at any point between the thickened portions 1'.

To ensure that the thickened portions, knots, bukmps or clamping bushes 1' do not protrude in a troublesome manner from the ubmrella handle 2 and the crown 3, the eyelet 4 can in each case be provided with a blind hole 4d into which the thickened portions 1' are completely pulled and can be secured by the stop effect already described. The shapes of the umbrella handles 2 and crowns 3 illustrated show the threading slots S preferably running transverse or longitudinally across a rounded tip or a rounded portion of the body. This makes it easier to pull the carrying member 1 in through the threading slot S because the frictional engagement and the force required in the initial phase and hence in the trickiest moment of pulling in the loop is greatly reduced. This results from the fact that the carrying member 1 can at first only be laid into, or begins to penetrate into, the threading slot S over half the rounded portion of the tip or over a quarter of the circumference of the tip (labelled ¼ R in FIG. 4) of the umbrella handle 2 or the crown 3.

Having described in detail the preferred embodiments, by way of description and not limitation, what is desired to claim and protect by Letters Patent is:

1. In an umbrella frame including an elongated stick having a longitudinal axis and first and second ends, a handle on said first end and a crown on said second end, at least one of said handle or crown having an eyelet extending transversely through opposite sides of an intermediate portion of said at least one of said handle or crown and at a right angle to the longitudinal axis of said stick, a flexible and manually-and-tensionally deformable carrying member threaded through said eyelet and being slidable in said eyelet and substantially filling the cross section of said eyelet when said crarying member is relaxes and in a non-tensionally-deformed condition, said at least one of said handle or crown through which said eyelet extends having a combination threading-slot-and-clamping channel comprising a pair of spaced wall portions each having a respective inner, abrupt transverse edge originating at said eyelet and extending parallel the entire extent of said eyelet, said walls extending radially from said eyelet the entire length of said eyelet and continuing radially into the outer surface of said at least one of said handle or crown and forming a transverse open slot at the outer surface of said at least one of said handle or crown, said abrupt transverse inner edges of said walls being spaced a wisth substantially less than a cross section of said eyelet and the cross section of said carrying member in its relaxed condition but permitting passage of said carrying member when the carrying member is tensionally deformed to a reduced cross section for permitting the deformed carrying member to be drawn manually past said abrupt inner edges, along the spaced walls, and through the slot in the outer surface of said/one of said handle or crown and away from the stick of said umbrella frame.

2. The structure as claimed in claim 1 in which said pair of walls diverge from the abrupt inner edges to the outer surface of said at least one of said handle or crown.

3. The structure as claimed in claim 2 in which the walls and outer surface of said at least one of said handle or crown intersect at a relieved edge extending across the outer surface of said slot.

4. The structure as claimed in claim 1 in which said eyelet includes an enlarged recess at one end thereof and adjacent the outer surface of sadi at least one of said handle or crown, said carrying member including an abutment portion received within said enlarged recess.

5. The structure as claimed in claim 1 in which said at lesat one of said handle or said crown comprises said handle, said handle having a pair of said eyelets and combination threading-slot-and-clamping channels as defined, said carrying member having an excess length stored in wrapped relation around said handle between said pair of eyelets.

6. The structure as claimed in claim 5 in which the combination threading-slot-and-clamping channels of said pair of eyelets open in opposite direction on said handle.

7. The structure as claimed in claim 1 in which each of said handle and said crown include one of said eyelets and combination threading-slots-and clamping channels as defined, said carrying member being terminally connected, at opposite ends, in one of the respective eyelets in said crown and handle and being manually removable from said eyelets through the respective combination threading-slot-and-clamping channel and extending from crown to handle along said stick whereby said carrying member and umbrella frame can be carried slung over a user's shoulder.

8. The structure as claimed in claim 1 in which said combination threading-slot-and-clamping channel opens from said at least one of said handle or crown longitudinally away from the stick of said frame.

9. The structure of claim 1 in which said combination threading-slot-and-clamping channel of said at least one of said handle or crown opens laterally of the longitudinally axis of said stick.

* * * * *

UNITED STATES PATENT AND TRADEMARK OFFICE

CERTIFICATE OF CORRECTION

PATENT NO. : 4,907,614

DATED : Mar. 13, 1990

INVENTOR(S) : Peter Stamm

It is certified that error appears in the above-identified patent and that said Letters Patent is hereby corrected as shown below:

Col. 1, line 40, change "tow" to--two--;
line 54, change "-U-German" to --German Gerbrauchmuster DE-U--.
Col.2, line 25, change "the-" to--the--.
Col. 5, line 24, change "isnertion" to--insertion--;
line 51, change "bukmps" to--bumps--.
Col. 6, line 16, change "crarying" to--carrying--;
line 17, change "relaxes" to--relaxed--;
line 29, change "wisth" to--width--;
line 53, change "lesat" to--least--.

Signed and Sealed this

Ninth Day of April, 1991

*Attest:*

*Attesting Officer*

HARRY F. MANBECK, JR.

*Commissioner of Patents and Trademarks*